US011452418B2

(12) United States Patent
Na et al.

(10) Patent No.: US 11,452,418 B2
(45) Date of Patent: Sep. 27, 2022

(54) STATION OF ROBOT CLEANER

(71) Applicant: Samsung Electronics Co., Ltd., Suwon-si (KR)

(72) Inventors: Woojin Na, Suwon-si (KR); Bosang Kim, Suwon-si (KR); Hakbong Lee, Suwon-si (KR); Shin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/985,942

(22) Filed: Aug. 5, 2020

(65) Prior Publication Data

US 2021/0038034 A1 Feb. 11, 2021

(30) Foreign Application Priority Data

Aug. 5, 2019 (KR) ..... 10-2019-0094786

(51) Int. Cl.
*A47L 9/28* (2006.01)
*A47L 9/14* (2006.01)

(52) U.S. Cl.
CPC ..... *A47L 9/149* (2013.01); *A47L 2201/024* (2013.01)

(58) Field of Classification Search
USPC ..... 15/319, 300.1
See application file for complete search history.

(56) References Cited

U.S. PATENT DOCUMENTS 5,472,465 A * 12/1995 Schmierer ..... A47L 9/1427 15/347
5,935,280 A * 8/1999 Lee ..... A47L 9/1427 55/378
6,560,816 B1 * 5/2003 Harrelson, II ..... A47L 5/38 15/314
8,347,453 B2 1/2013 Frackowiak
9,078,548 B2 7/2015 Han et al.
9,949,606 B2 4/2018 Han et al.
(Continued)

FOREIGN PATENT DOCUMENTS

CN 109480714 A 3/2019
JP 2000-070197 A1 3/2000
(Continued)

OTHER PUBLICATIONS

International Search Report dated Oct. 27, 2020 in International Patent Application No. PCT/KR2020/010103.
(Continued)

*Primary Examiner* — Joseph J Hail
*Assistant Examiner* — Dana Lee Poon
(74) *Attorney, Agent, or Firm* — Staas & Halsey LLP

(57) ABSTRACT

A station suctioning dust from the robot cleaner includes a docking suction port connectable to a robot cleaner, a dust container to store dust from the robot cleaner, a duct connected to the docking suction port and the dust container, a holder disposed in the dust container, and to which a dust bag is mountable, and a lever configured to hinder a connection of the holder and the duct while the dust bag is in a separated state from the holder, and the lever allows the connection of the holder and the duct while the dust bag is in a mounted state to the holder.

13 Claims, 11 Drawing Sheets

(56) References Cited

U.S. PATENT DOCUMENTS

| | | | | |
|---|---|---|---|---|
| 10,154,768 | B2 | 12/2018 | Morin et al. | |
| 10,463,215 | B2 | 11/2019 | Morin et al. | |
| 2007/0074367 | A1* | 4/2007 | Bosses | A47L 9/1427 15/352 |
| 2012/0291809 | A1 | 11/2012 | Kuhe et al. | |
| 2012/0304415 | A1 | 12/2012 | Bosses | |
| 2014/0359966 | A1 | 12/2014 | Han et al. | |
| 2015/0265120 | A1 | 9/2015 | Han et al. | |
| 2016/0374528 | A1* | 12/2016 | Morin | A47L 9/2842 15/319 |
| 2019/0133399 | A1 | 5/2019 | Morin et al. | |
| 2020/0359868 | A1 | 11/2020 | Bo | |

FOREIGN PATENT DOCUMENTS

| | | | | |
|---|---|---|---|---|
| JP | 6010722 | | 10/2016 | |
| KR | 20-2000-0004922 | | 3/2000 | |
| KR | 10-2000-0040258 | | 7/2000 | |
| KR | 10-2001-0054948 | | 7/2001 | |
| KR | 10-0545237 | | 1/2006 | |
| KR | 10-0692577 | B1 | 3/2007 | |
| KR | 10-2014-0144435 | A | 12/2014 | |
| WO | WO-2010028120 | A2 * | 3/2010 | B01D 46/42 |
| WO | WO 2016/105702 | A1 | 6/2016 | |

OTHER PUBLICATIONS

European Search Report dated Mar. 3, 2022 issued in European Application No. 20 84 9597.

* cited by examiner

STATION OF ROBOT CLEANER

CROSS-REFERENCE TO RELATED APPLICATIONS

This application is based on and claims priority under 35 U.S.C. § 119 to Korean patent application number 10-2019-0094786, filed on Aug. 5, 2019, in the Korean Intellectual Property Office, the disclosure of which is incorporated by reference herein in its entirety.

BACKGROUND

1. Field

The disclosure relates to a station with improved structure for recognizing a dust bag and improved durability.

2. Description of the Related Art

A robot cleaner is a device which moves on its own and cleans a certain area without a separate manipulation from a user. A station may be a device which charges the robot cleaner and removes dust collected in the robot cleaner, and may be disposed fixed to a pre-set location.

However, there have been problems such as dust scattering in the station as the station sucks the dust from the robot cleaner even when a dust bag for gathering dust of the robot cleaner is not disposed on the station, or dust being suctioned into the motor suctioning dust and damaging the station.

Further, although an electrical sensor for detecting a dust bag is provided to solve the above-described problems, there have been problems such as the durability of the sensor decreasing and the manufacturing costs of the sensor increasing as a result of the cost of the sensor alone.

SUMMARY

The disclosure provides a station with improved dust bag recognition structure and improved durability.

According to an embodiment, a station for suctioning dust from a robot cleaner comprises a docking suction port connectable to a robot cleaner, a dust container to store dust from the robot cleaner, a duct connected between the docking suction port and the dust container, a holder disposed in the dust container, and to which a dust bag is mountable, and a lever configured to hinder a connection of the holder and the duct while the dust bag is in a separated state from the holder, and the lever allows the connection of the holder and the duct while the dust bag is in a mounted state to the holder.

The station may comprise a driver configured to suction the dust from the robot cleaner to the dust bag when the robot cleaner is connected to the docking suction port.

The lever may be rotatably coupled to the holder, and based on the dust bag being separated from the holder, the lever is protruded toward the duct, may be maintained in a first state hindering the connection of the duct and the holder, and based on the dust bag being mounted to the holder, the lever may be in a second state pushed by the dust bag and rotating toward the holder.

One end part of the duct may be protruded and disposed in an inner space of the dust container, the holder may comprise an insertion opening for the one end part of the duct to be inserted, and, based on the lever being in the first state, the one end part of the duct may be spaced apart from the insertion opening, and based on the lever being in the second state, the one end part of the duct may be inserted in the insertion opening.

The dust container may comprise a protruding part to interact with the lever in the first state and an accommodating part to accommodate a part of the lever in the second state.

The protruding part and the accommodating part may be disposed to a position facing the lever which is rotatably coupled to the holder.

The lever may comprise a first lever part which rotates by being interacted with a part of the dust bag based on the dust bag being coupled to the holder and a second lever part which is integrally formed with the first lever part, interacted with the protruding part in the first state, and disposed in the accommodating part in the second state.

The holder may comprise a sliding groove to which the dust bag is slidingly coupled on a surface of the holder and the lever in the first state may be protruded and disposed on the surface of the holder.

The holder may comprise an elastic member pressing the lever to maintain the lever at the first state to be protruded and disposed continuously on the surface of the holder.

The holder may comprise a lever groove provided for the lever to rotate, and the lever may move between the first state, which is protruded and disposed on the one surface of the holder, and the second state, which is rotated by being interacted with dust bag.

The station may further comprise an inner space of the dust container connected to be openable and closable, and comprising a cover member including an interacting member protruded toward the inner space of the dust container, and the holder may comprise a cover interacting part protruded on an upper part of the holder, and based on the holder and the duct being spaced apart, the cover interacting part contacts with the obstructing member and prevents the cover member from closing.

The holder, based on the holder and the duct being in a coupled state, may be coupled on a contact surface of the dust container.

BRIEF DESCRIPTION OF THE DRAWINGS

The above and other aspects, features and advantages of certain embodiments of the disclosure will be more apparent from the following detailed description, taken in conjunction with the accompanying drawings, in which.

DETAILED DESCRIPTION

Figure 1:
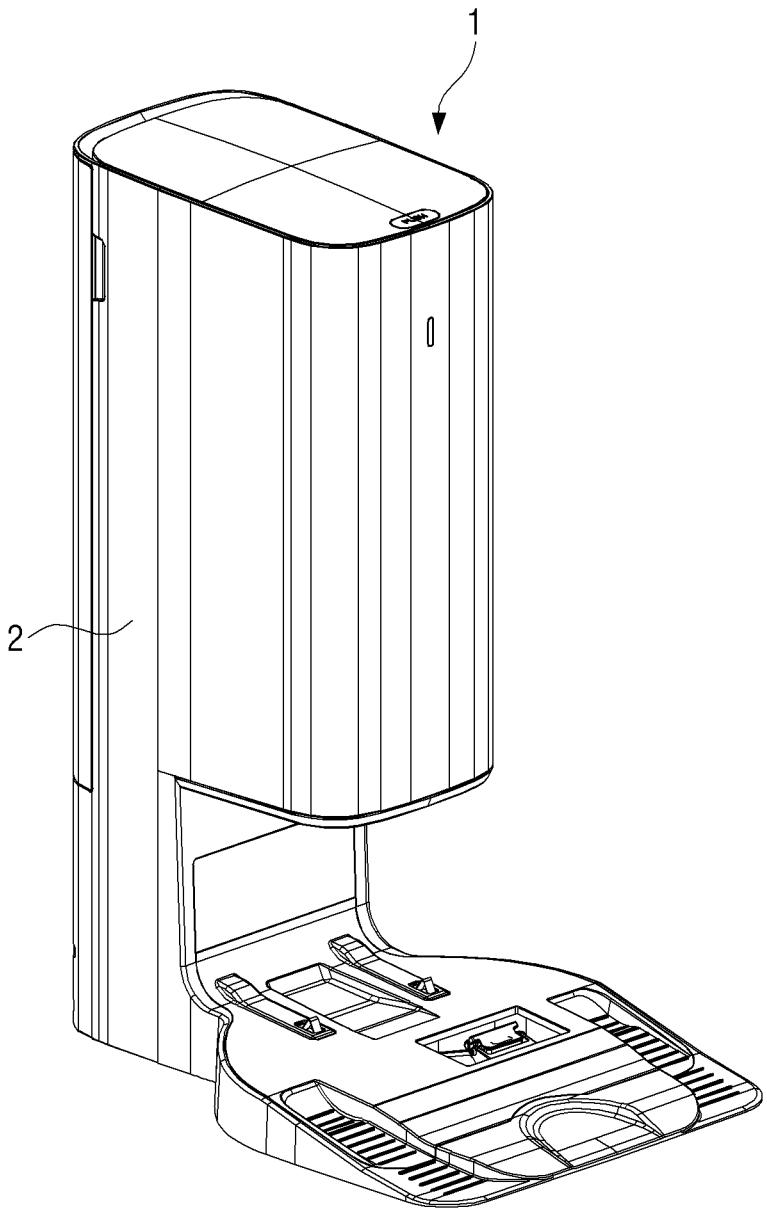
FIG. 1 is a perspective view illustrating a station according to an embodiment of the disclosure.

Exemplary embodiments of the disclosure will be described with reference to the accompanying drawings to sufficiently understand the configurations and effect of the disclosure. However, the disclosure is not limited to the embodiments disclosed herein, and the disclosure may be embodied to various forms and various modifications may be applied thereto. Rather, the descriptions on the embodiments are provided so that this disclosure will be thorough and complete and will fully convey the scope of the disclosure to those skilled in the art. In the drawings, elements may be enlarged compared to their actual sizes for convenience of description, and ratio of each element may be exaggerated or reduced.

It will be understood that when a certain element is disclosed as being "on" or "connected to" another element, this may not only indicate being directly touching on or connected to another element, but also other element may be therebetween. On the other hand, when a certain element is disclosed as being "directly on" or "directly connected to" another element, it may be understood as there being no other element therebetween. Other expressions describing the relationship between elements, such as, " . . . between" and "directly . . . between" may also be interpreted in the same manner.

Terms such as first and second may be used to describe various elements, but the elements are not to be understood as being limited by the terms. The terms may be used to distinguish one element from another element. For example, a first element may be designated as a second element, and likewise, a second element may be designated as a first element without departing from the claimed scope.

A singular expression may include a plural expression, unless otherwise specified. It is to be understood that the terms such as "comprise" or "consist of" are used herein to designate a presence of a characteristic, number, step, operation, element, component, or a combination thereof, and that one or more other characteristics, numbers, steps, operations, elements, components, or a combination thereof may be added.

The terms used in the embodiments may be interpreted in the commonly known meaning to those of ordinary skill in the relevant technical field, unless otherwise specified.

A structure of a station 1 according to an embodiment of the disclosure will be described below with references to FIGS. 1 to 3.

Figure 2:
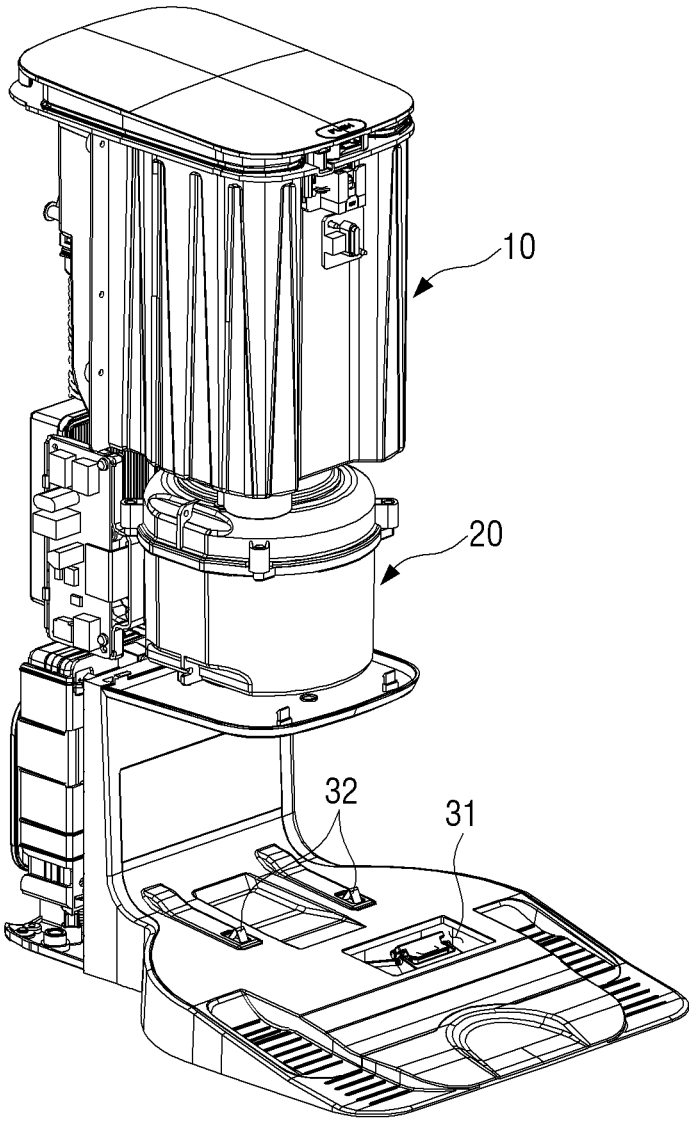
FIG. 2 is a perspective view illustrating a station with a cover removed from the structure of FIG. 1.
Figure 3:
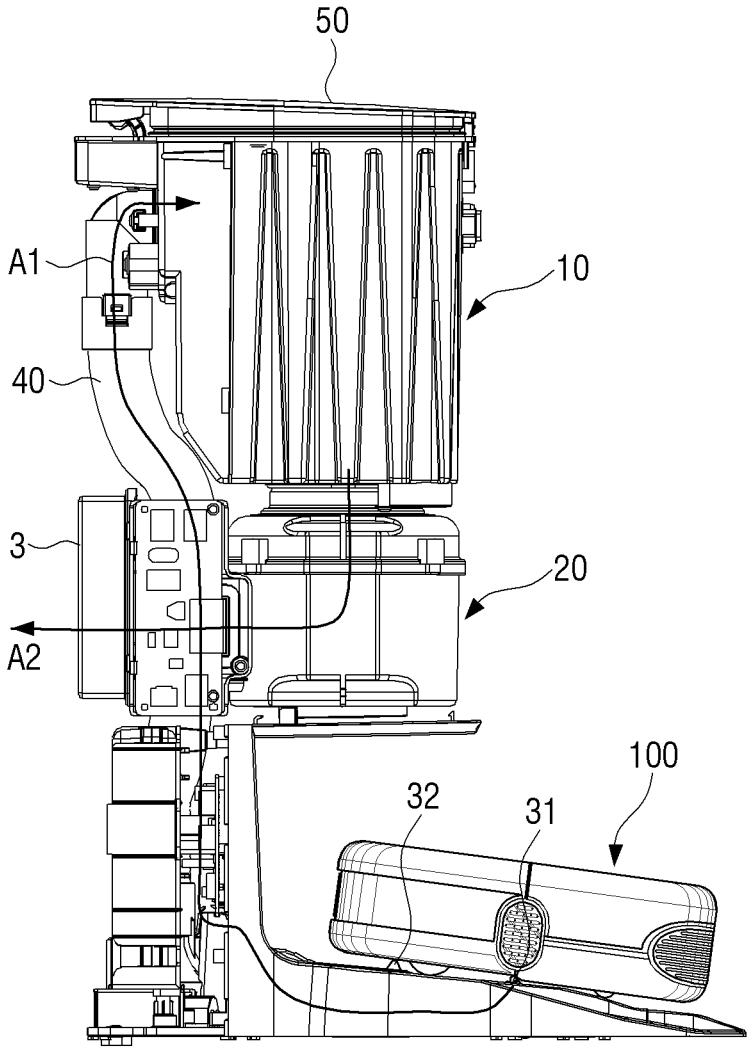
FIG. 3 is a schematic view illustrating a station and a robot cleaner being in a connected state according to an embodiment of the disclosure.

FIG. 1 is a perspective view illustrating a station 1 according to an embodiment of the disclosure, FIG. 2 is a perspective view illustrating a station 1 with a housing 2 removed from the structure of FIG. 1, and FIG. 3 is a schematic view illustrating a station 1 and a robot cleaner 100 being in a connected state according to an embodiment of the disclosure.

The station 1 may charge the robot cleaner 100 while simultaneously suctioning dust collected in the robot cleaner 100.

The station 1 may include a housing 2 which forms an outer part of the station 1, a dust container 10 in which a dust bag 200 is disposed, a driver 20 which suctions dust into a dust bag 200 from the robot cleaner 100 connected with a docking suction port 31, a duct 40 which connects the docking suction port 31 with the dust container 10, and a holder 60 which is disposed to be rotatable in the dust container and selectively couples with the duct 40.

The housing 2 may form the outer part of the station 1, and protect the various electronic devices disposed in an inner part of the station 1. The housing 2 may be in various shapes, and any shape may be sufficient so long as foreign substances from the outer part of the station 1 are prevented from being introduced to the inner part of the station 1.

The dust container may include an inner space S (referring to FIG. 7A) for the dust bag 200 to be disposed. That is, the dust container 10 may be connected with the duct 40, and may accommodate the dust bag 200 which collects dust introduced from the duct 40.

The inner space S may be a space for accommodating the dust bag 200, and the inner space S may be selectively opened and closed by a cover member 50 connected with the dust container 10.

The shape of the dust container 10 may be varied, and may be disposed to various positions of the station 1 according to necessity.

In addition, the dust container 10 may include a protruding part 11 which interacts with a lever 70 in a first state and an accommodating part 12 which accommodates a part of the lever 70 in a second state. The protruding part 11 and the accommodating part 12 may be disposed at a position facing the lever 70 on the holder 60.

Further, the accommodating part 12 may be formed so that a portion of the lever 70 may be seated.

That is, the protruding part 11 and the accommodating part 12 may be disposed adjacent to a position in which the holder 60 in the dust container 10 is disposed. Further, the protruding part 11 and the accommodating part 12 may be disposed adjacent to each other.

The driver 20 may be connected with the inner space S of the dust container 10, and provide a driving power capable of suctioning dust from the robot cleaner 100 connected to the station 1.

For example, the driver 20 may include a motor (not shown) and a fan (not shown) to provide driving power for suctioning dust in the station 1.

Accordingly, as illustrated in FIG. 3, the driver 20 may form a suction channel A1 through which dust is suctioned to the inner part of the station 1 and a discharge channel A2 through which dust is discharged to the outer part of the station 1 after the dust is removed from the suction channel A1.

For example, the suction channel A1 may, through the suction force of the driver, collect foreign substance collected in the robot cleaner 100 to the docking suction port 31, the duct 40 connected with the docking suction port 31, the dust container 10 connected with the duct 40, and the dust bag 200 disposed in the dust container 10.

Further, the air after the dust from the dust bag 200 is filtered may be discharged to the outer part of the station 1 through the driver 20 and the outlet 3.

Because the suction channel A1 moves through the duct 40 in the station 1, and the discharge channel A2 is be formed through a space of the outer part of the duct 40, the suction channel A1 and the discharge channel A2 may not be intercrossed.

In addition, the discharge channel A2 may discharge clean air to the outer part of the station 1 through primary filtering with a filter of the dust bag 200 itself, and through a filter disposed in the outlet 3.

The duct 40 may be disposed at the inner part of the station 1, and form a space in which the suction channel A1 may pass. Further, the duct 40 may be disposed between the docking suction port 31 which suctions dust from the robot cleaner 100 and the dust container 10, and connects the docking suction port 31 with the dust container 10.

The duct 40 may prevent dust moving in the suction channel A1 from scattering in the inner part of the station 1, while simultaneously guiding the dust to the dust bag 200 disposed in the dust container 10.

Further, one end part 40*a* (referring to FIG. 7A) of the duct 40 may protrudingly dispose the inner space S of the dust container 10. That is, the one end part 40*a* of the duct 40 may be extendingly disposed to the inner space S of the dust container 10.

Accordingly, the holder 60 may be rotated to the position at which the duct 40 is disposed to connect the holder 60 with the duct 40, while simultaneously connecting the dust bag 200 fixed to the holder 60 with the duct 40.

The holder 60 may be coupled with the dust bag 200, and by selectively connecting with the duct 40, the duct 40 and the dust bag 200 may be selectively connected. The specific structure of the holder 60 will be described below.

Further, the station 1 may include a charging terminal 32 for charging the robot cleaner 100 connected with the station 1. The charging terminal 32 may charge the robot cleaner 100 connected to the station 1 through an external power source (not shown), and may be disposed adjacent to the docking suction port 31.

Accordingly, based on the robot cleaner 100 being connected to the station 1, the station 1 may suction the dust from the inner part of the robot cleaner 100 through the docking suction port 31, while simultaneously charging a battery of the robot cleaner 100 through the charging terminal 32.

Further, the station 1 may include a cover member 50 which is connected so that the inner part of the dust container 100 is openable and closable, and may selectively open and close the inner space S of the dust container 10.

Figure 7A:
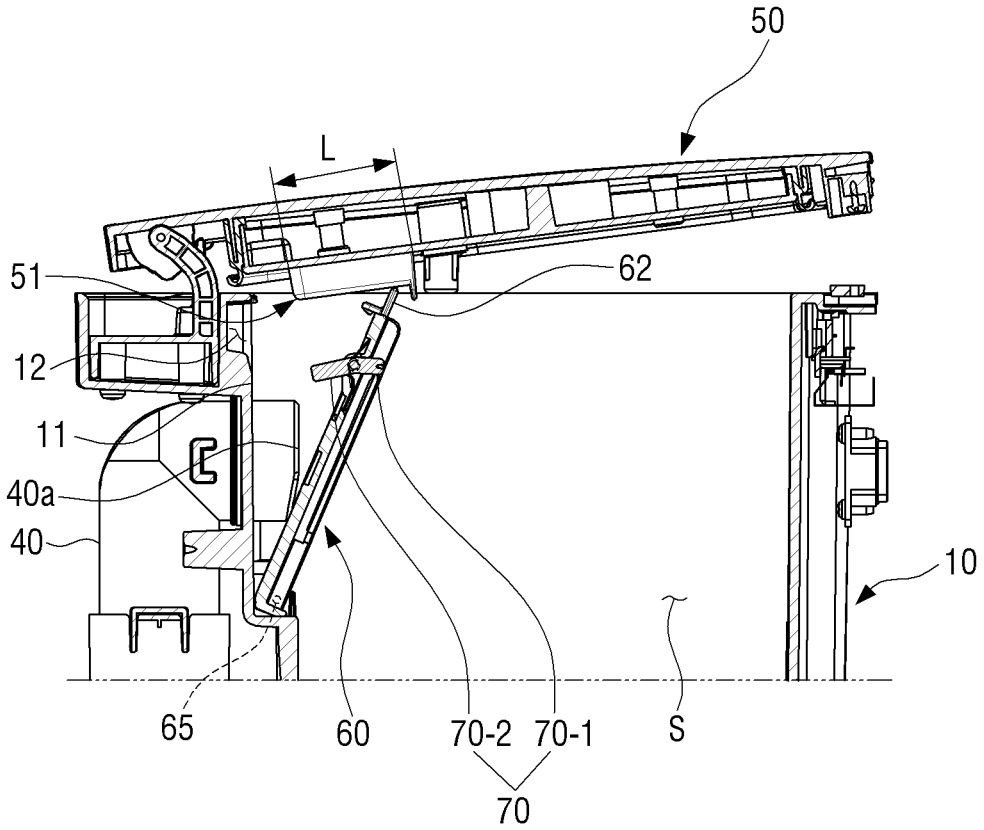
FIG. 7A is a cross-sectional view illustrating a part of a station showing a lever of a first state according to an embodiment of the disclosure.

Referring to FIG. 7A, the cover member 50 may be disposed to be rotatable with the dust container 10, and may include an interacting member 51 which is protruded toward the inner space S of the dust container 10. The interacting member 51 may be disposed adjacent to the position to which the holder 60 in the dust container 10 is disposed.

Further, the interacting member 51 may be protrudingly formed to a pre-set length L. The pre-set length L may, because of the holder 60 rotating in the dust container 10, correspond with rotating radius of a cover interacting part 62. Accordingly, prior to a latch 68 of the holder 60 being inserted and fixed to a latch groove 14 of the dust container 10, the cover interacting part 62 of the holder 60 may interact with the interacting member 51, and prevent the cover member 50 from closing the inner part of the dust container 10.

The specific structure of the holder 60 according to an embodiment will be described below with reference to FIGS. 4 to 6.

Figure 4:
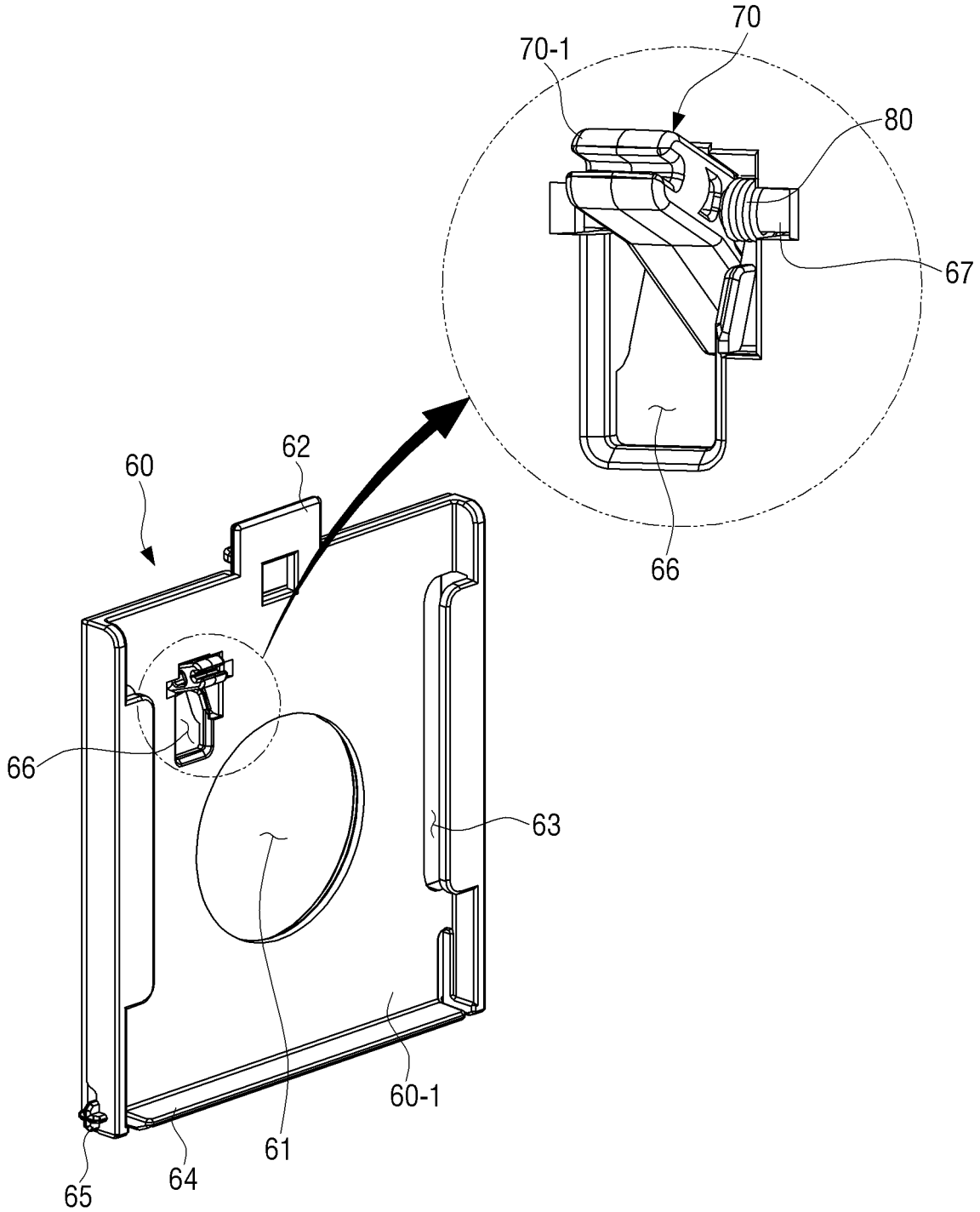
FIG. 4 is a front perspective view illustrating a holder according to an embodiment of the disclosure.
Figure 5:
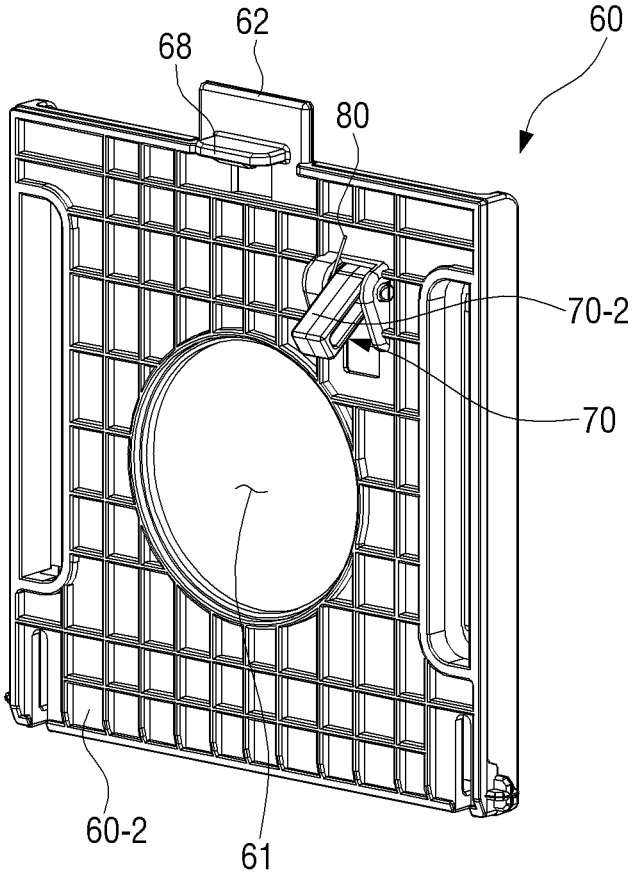
FIG. 5 is a rear perspective view illustrating a holder according to an embodiment of the disclosure.
Figure 6:
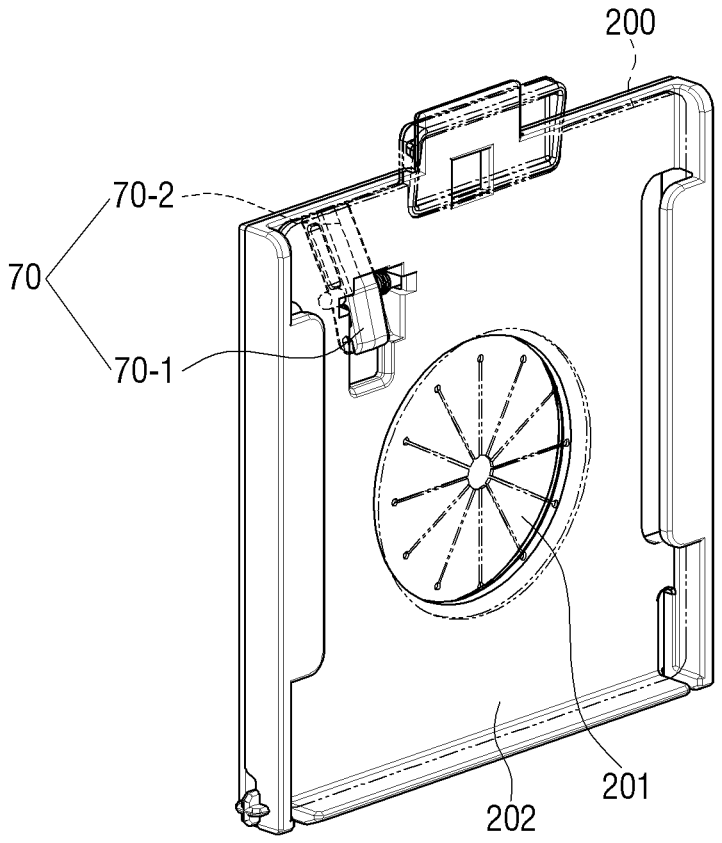
FIG. 6 is a perspective view illustrating a holder coupled with a dust bag according to an embodiment of the disclosure.

FIG. 4 is a front perspective view illustrating a holder 60 according to an embodiment of the disclosure, FIG. 5 is a rear perspective view illustrating a holder 60 according to an embodiment of the disclosure, and FIG. 6 is a perspective view illustrating a holder 60 coupled with a dust bag 200 according to an embodiment of the disclosure.

The holder 60 may be disposed to be rotatable in the dust container 10, and may be selectively coupled with the duct 40. Further, the holder 60 may while fixing the dust bag 200 simultaneously couple the fixed dust bag 200 with the duct 40.

That is, the holder 60 may be configured so that the dust bag 200 is mountable in the dust container 10.

Further, the holder 60 may include a surface 60-1 to which a fixing plate 202 of the dust bag 200 is fixedly disposed, an insertion opening 61 which is formed on the one surface 60-1 and to which the one end part 40*a* of the duct 40 may be inserted, a cover interacting part 62 capable of interacting with the cover member 50, a sliding groove 63 to which the fixing plate 202 of the dust bag 200 may be inserted, a fixing part 64 which fixes the fixing plate 202 of the dust bag 200, and a pair of rotating protrusions 65 which form a rotating axis of the holder 60.

The holder 60 may be in a plate shape with the surface 60-1 and a other surface 60-2, and an insertion opening 61 passing through the one surface 60-1 and the other surface 60-2 at the center part may be formed.

Further, the holder 60 may be disposed to be rotatable in the dust container 10 through the pair of rotating protrusions 65 formed at the lower end part of the holder 60. That is, the holder 60 may be coupled to the inner part of the dust container and swing the inner part of the dust container 10.

The position to which the holder is disposed may, based on the holder 60 rotating about the rotating protrusion 65, be a position at which the one end part 40*a* of the duct 40 may be inserted to the insertion opening 61 of the holder 60.

On both sides of the one surface 60-1 of the holder 60 a pair of sliding grooves 63 may be formed, and on the one end part of the sliding groove 63 a fixing part 64 protruded on the one surface 60-1 may be formed.

That is, the sliding groove 63 may be configured so that the fixing plate 202 of the dust bag 200 may be slidingly coupled on the one surface 60-1 of the holder 60.

Accordingly, the fixing plate 202 of the dust bag 200 may be slidingly inserted by the pair of sliding grooves 63, and, by being interacted by the fixing part 64, the fixing plate 202 of the dust bag 200 on the one surface 60-1 of the holder 60 may be stably fixed.

The dust bag 200 may include the fixing plate 202, which is a product with a matching dimension to the station 1, and may be connected with the inner part of the dust bag 100 and formed with an inlet 201. In addition, the dust bag 200 may be provided with a dust filtering function of a predetermined level or more. Accordingly, even when dust is introduced into the dust bag 200, the dust may be filtered by the outer surface of the dust bag 200, and the dust-filtered air may pass through the dust bag 200 to be discharged toward the outer part of the station 1 by the driver 20.

The fixing part 64 may fix the fixing plate 202 to a predetermined position on the holder 60. Accordingly, the inlet 201 formed on the fixing plate 202 and the insertion opening of the holder 60 may be disposed to a position facing each other.

The insertion opening 61 may be disposed a center part of the holder 60. Further, the insertion opening 61 may be disposed to a position corresponding to the inlet 201 of the fixing plate 202. Accordingly, while the fixing plate 202 is in a fixed state by the holder 60, the one end part 40*a* of the duct 40 may be inserted into the insertion opening 61 while the one end part 40*a* of the duct 40 may also be inserted into the inlet 201 of the dust bag simultaneously.

That is, while the holder 60 is connected with the duct 40, the duct may be spatially connected to the dust bag 200 simultaneously.

Further, the holder 60 may include a lever groove 66 formed at a position different from the insertion opening 61 of the holder 60. The lever groove 66 may be connected with the holder 60 for the lever 70 to be rotatable.

The size of the lever groove 66 may be formed to a size suitable for the lever 70 to be connected to the holder 60 and not interact with a part of the holder 60.

Further, the holder 60 may include a coupling axis 67 connected to the lever 70. Based on the lever 70 in the coupling axis 67 being disposed to be rotatable, the lever 70 may rotate about the coupling axis 67 with respect to the holder 60.

The cover interacting part 62 may be protruded on an upper part of the holder 60. Further, the cover interacting part 62 may prevent the cover member 50 from being closed by being in contact with the interacting member 51 in a state in which the holder 60 and the duct 40 are spaced apart.

Further, the holder 60 may be integrally formed through an injection molding process. Accordingly, the insertion opening 61, the cover interacting part 62, the sliding groove 63, the fixing part 64, the rotating protrusion 65, the lever groove 66, and the coupling axis 67 of the holder 60 may be integrally formed without a separate process and thus, manufacturing costs may be reduced.

In addition, the station 1 may include a lever 70 for obstructing the connection of the holder 60 and the duct 40 while the dust bag 200 is in a separated state from the holder 60, and for allowing the connection of the holder 60 and the duct 40 while the dust bag 200 is in a coupled state with the holder 60.

Further, the lever 70 may be coupled to the holder 60 to be rotatable, and when the dust bag 200 is separated from the holder 60, the lever 70 may be protruded toward the direction of the duct 40 and maintained at the first state obstructing the connection of the duct 40 and the holder 60, and when the dust bag 200 is mounted to the holder 60, the lever 70 may be in a second state rotating toward the holder 60 by being pushed by the dust bag 200.

The lever 70 may be connected to the holder 60 through the coupling axis 67, and the lever 70 may include a first lever part 70-1 which rotated to be interacted with a part of the dust bag 200 when the dust bag 200 is coupled to the holder 60, and a second lever part 70-2 which is integrally formed with the first lever part 70-1 and interacted with the protruding part 11 (referring to FIG. 7A) when in a first state and disposed in the accommodating part 12 (referring to FIG. 7A) when in the second state.

That is, the first lever 70-1 in the first state may be protrudingly disposed on the one surface 60-1 of the holder 60, and the second lever part 70-2 may be in contact with the protruding part 11 and obstruct the holder 60 and the duct 40 from connecting.

Further, the first lever part 70-1 in the second state may rotate toward the direction of the other surface 60-2 of the holder 60, and the second lever part 70-2 may move toward a direction closest to the other surface 60-2 of the holder 60 and allow the holder 60 and the duct to connect.

The first lever part 70-1 and the second lever part 70-2 may be integrally formed.

For example, the first lever part 70-1 may be disposed to face the one surface 60-1 of the holder 60 based on the coupling axis 67, and may interact with the fixing plate 202 of the dust bag 200.

That is, as illustrated in FIGS. 4 and 5, the lever 70 may be positioned at the first state protrudingly disposed on the one surface 60-1 of the holder 60. The first lever part 70-1 in the first state may be protrudingly disposed on the one surface 60-1 of the holder 60, and the second lever part 70-2 may be in a disposed state on the other surface 60-2 of the holder 60.

Further, as illustrated in FIG. 6, when the fixing plate 202 of the dust bag 200 is slidingly inserted in the holder 60, the first lever part 70-1 is interacted with the fixing plate 202 and may rotate centered on the coupling axis 67.

That is, as illustrated in FIG. 6, the lever 70 may move from the first state to the rotated second state where the lever is rotated by interacting with the dust bag 200. Accordingly, the first lever part 70-1 may rotate in the lever groove 66, and the second lever part 70-2 connected to the first lever part 70-1 may also rotate.

Further, the holder 60 may include an elastic member 80 pressing the lever 70 so as to continuously maintain the lever in the first state with respect to the coupling axis 67 of the holder.

The elastic member 80 may press the lever 70 for the lever 70 of the first state to be protrudingly disposed continuously on the one surface 60-1 of the holder 70.

For example, the elastic member 80 may press the lever 70 for the first lever part 70-1 to be disposed on the one surface 60-1 of the holder 60, and for the second lever part 70-2 to be disposed on the other surface 60-2 of the holder.

Further, the elastic member 80 may, when the fixing plate 202 of the dust bag 200 in the holder 60 is separated, move the lever 70 from the second state back to the first state.

The function and operation of the holder 60 and the lever 70 according to an embodiment will be described below with reference to FIGS. 7A to 9B.

Figure 7B:
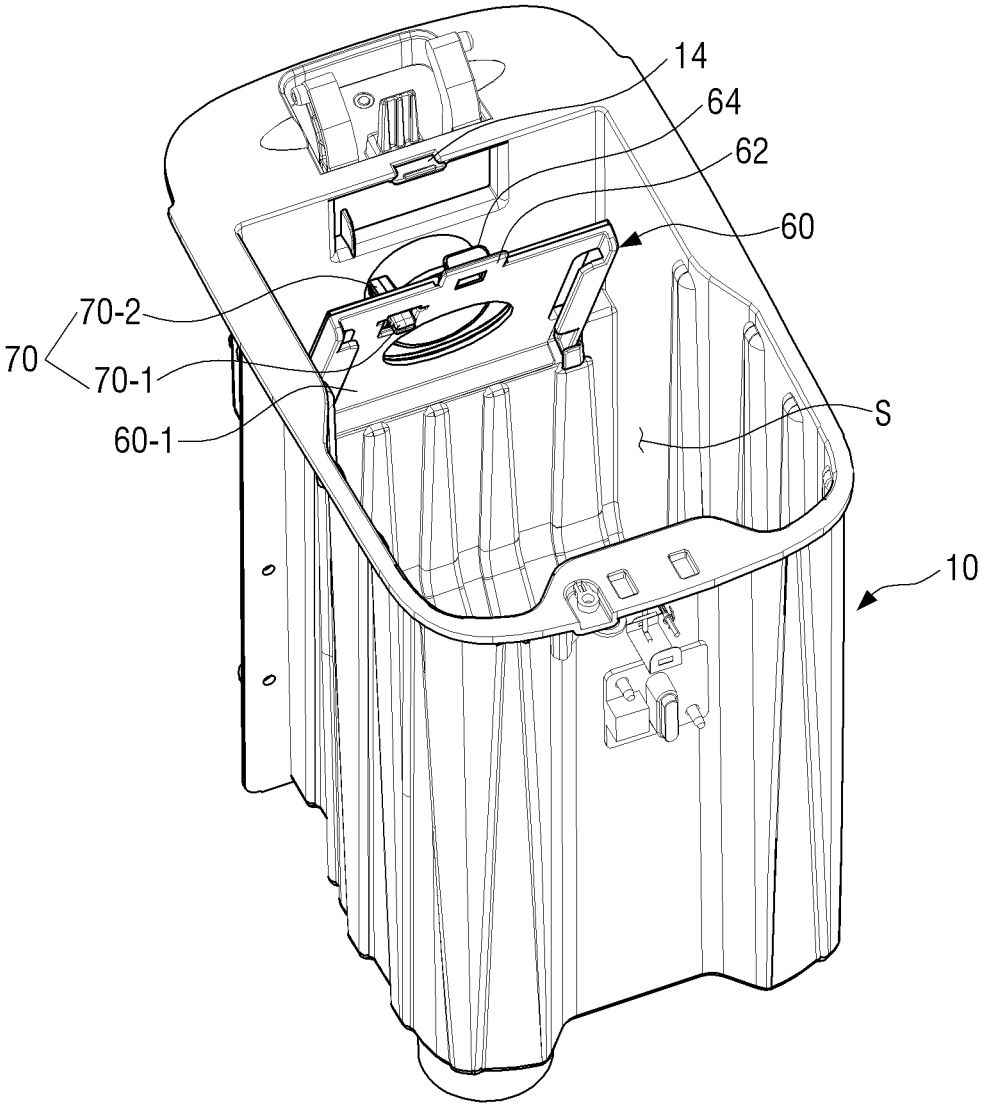
FIG. 7B is a perspective view illustrating a state of FIG. 7A.
Figure 8:
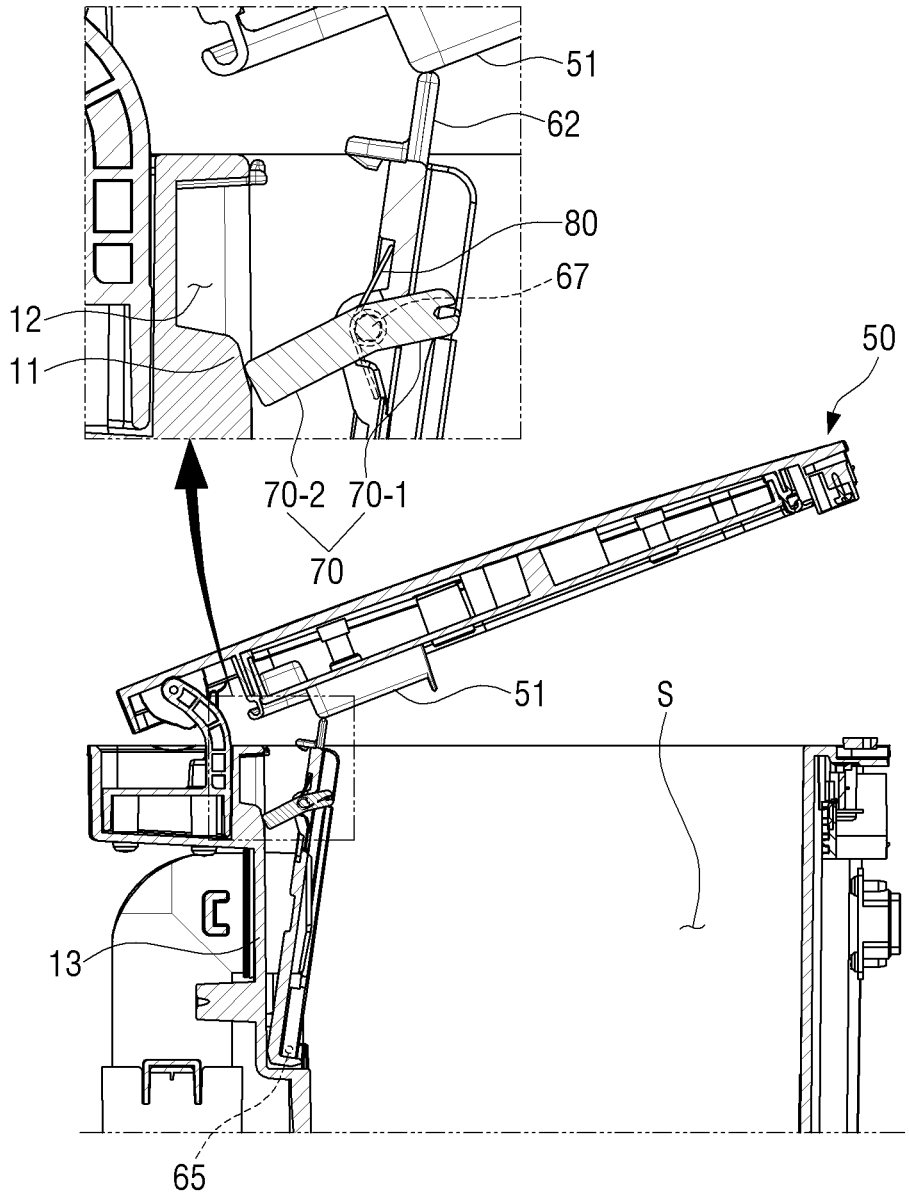
FIG. 8 is a cross-sectional view illustrating a part of a station showing a lever of a first state according to an embodiment of the disclosure.
Figure 9A:
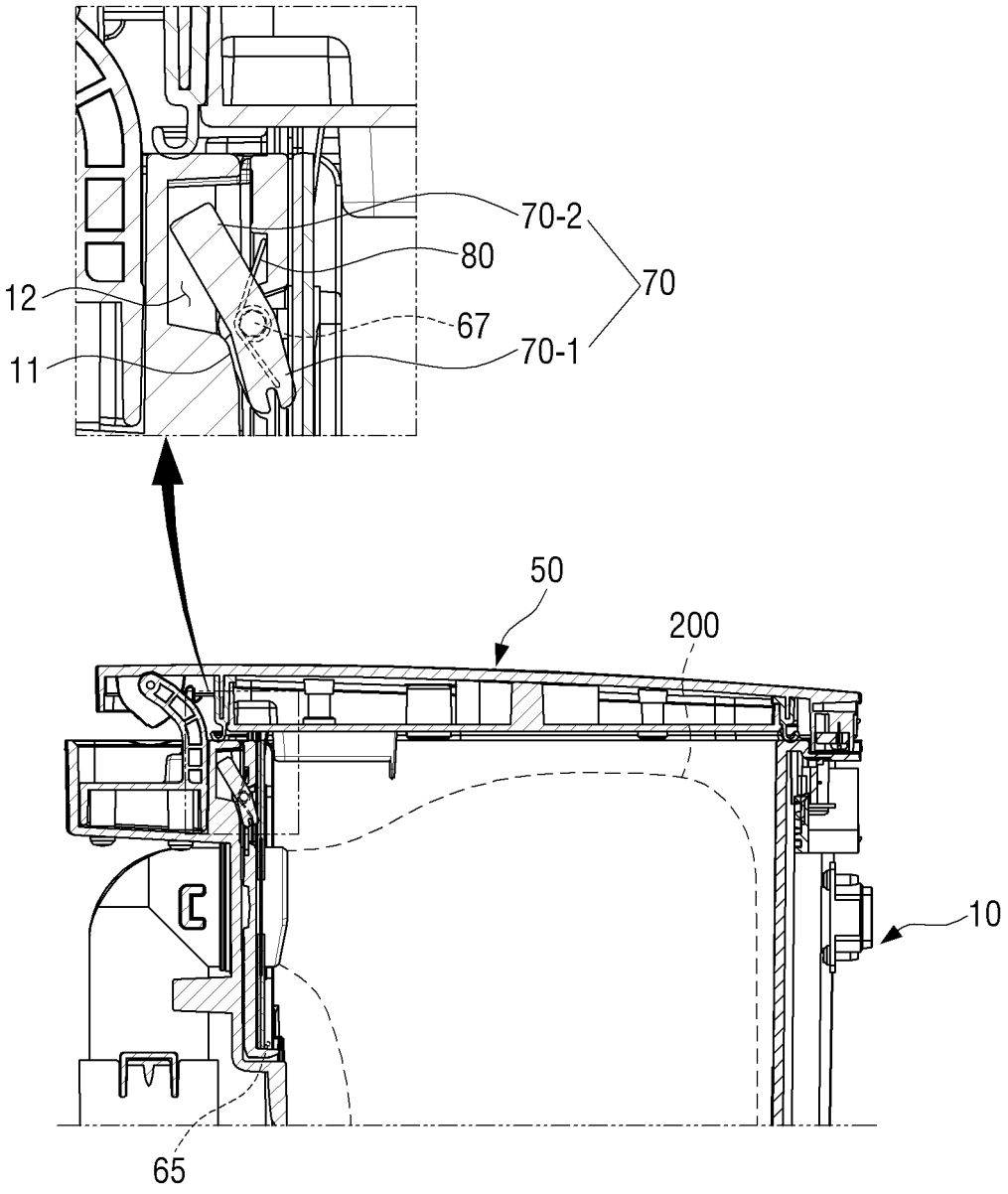
FIG. 9A is a cross-sectional view illustrating a part of a station showing a lever of a second state according to an embodiment of the disclosure.
Figure 9B:
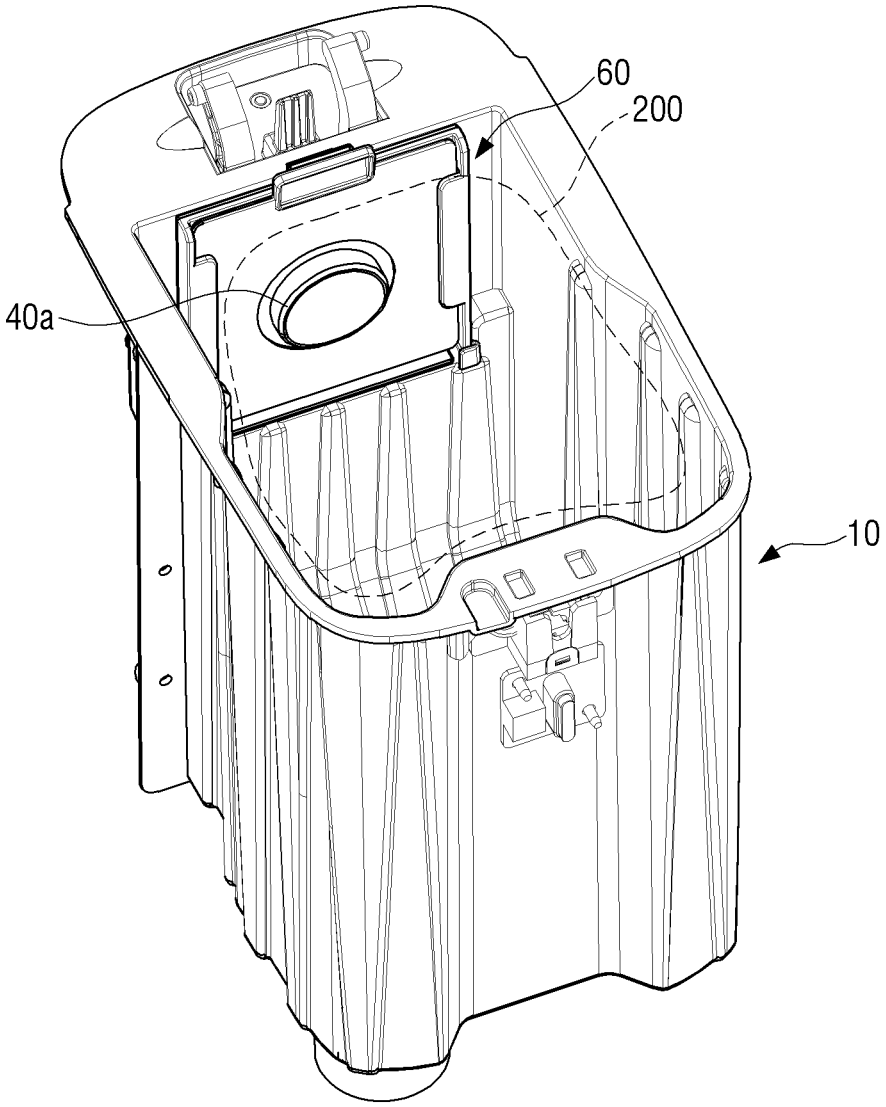
FIG. 9B is a perspective view illustrating a state of FIG. 9A.

FIG. 7A is a cross-sectional view illustrating a part of a station 1 showing a lever 70 of a first state according to an embodiment of the disclosure, FIG. 7B is a perspective view illustrating a state of FIG. 7A, FIG. 8 is a cross-sectional view illustrating a part of a station showing a lever of a first state according to an embodiment of the disclosure, FIG. 9A is a cross-sectional view illustrating a part of a station 1 showing a lever 70 of a second state according to an embodiment of the disclosure, and FIG. 9B is a perspective view illustrating a state of FIG. 9A.

FIGS. 7A to 8 illustrate a dust bag 200 which is not inserted in a holder 60, and a lever 70 being in a first state.

As illustrated in FIGS. 7A and 7B, the dust bag 200 may not be disposed in the dust container 10. Accordingly, the lever 70 may not be interacted with the fixing plate 202 of the dust bag 200, and the first lever part 70-1 may be protrudingly disposed on the one surface 60-1 of the holder, and the second lever part 70-2 may be protrudingly disposed on the other surface 60-2 of the holder 60.

Further, because the holder 60 is a state spaced apart from the one end part 40*a* of the duct 40, the holder 60 and the duct 40 may not be in a connected state. In addition, when the lever 70 is in the first state, the interacting member 51 is interacted with the cover interacting part 62 of the holder 60 and may prevent the cover member 50 from being closed.

In addition, as illustrated in FIG. 8, the user may rotate the holder 60, which is not in a coupled state with the dust bag 200, to a position adjacent with the duct 40. In this case, the lever 70 may be interacted by the protruding part 11 formed at the inner part of the dust container 10, and may prevent the holder 60 and the duct 40 from connecting.

The first lever part 70-1 of the lever 70 may be in a protrudingly disposed state on the one surface 60-1 of the holder 60, and the second lever part 70-2 connected to the first lever part 70-1 in the first state may be in a state farther from the second state with respect to the other surface 60-2 of the holder 60.

That is, because the fixing plate 202 of the dust bag 200 is not in a coupled state in the holder 60, the first lever part 70-1 is not in an interacting state with the fixing plate 202, and the first state may be maintained by the elastic member 80.

Even when the holder 60 is rotated about the rotating protrusion 65, the second lever part 70-2 may first be in contact with the protruding part 11 of the dust container 10 prior to the one end part 40*a* of the duct 40 being inserted in the insertion opening 61 of the holder 60.

The second lever part 70-2 and the protruding part 11 may prevent the one end part of the duct 40 from being inserted in the insertion opening 61 of the holder 60. Accordingly, the user may not connect the holder 60 with the duct 40 when the dust bag 200 is not in a fixed state on the holder 60.

That is, the other surface 60-2 of the holder 60 and the contact surface 13 of the dust container 10 may not be contacted by the lever 70. Likewise, the one end part 40*a* of the duct 40 may be spaced apart with the insertion opening 61.

Further, because the cover interacting part 62 of the holder 60 is in an interacted state with the interacting member 51 of the cover member 50, the cover member 50 may not close the inner space S of the dust container 10. Accordingly, by checking that the cover member 50 is not in a closed state visually and physically, the user may recognize that the dust bag 200 including the fixing plate 202 is not in inserted into the holder 60.

That is, the station 1 according to an embodiment may prevent the user from using a general plastic bag, not the dust bag 200 including a dust filter function for filtering dust of a predetermined amount or more in the station 1 and a fixing plate 202, through a structural configuration of the station 1. Further, the station 1 may recognize whether the dust bag 200 is coupled or not as a structural manner, and notify the user of whether the dust bag 200 is coupled or not in a structure manner.

Further, the interacting member 51 may, taking into consideration the distance in which the protruding part 11 and the second lever part 70-2 are interacted, be extendingly formed to a pre-set length L. Accordingly, as illustrated in FIG. 8, the second lever part 70-2 may be interacted with the protruding part 11 while simultaneously the cover interacting part 62 of the holder 60 may be interacted with the interacting member 51 of the cover member 50.

The coupled structure of the holder 60 and the duct 40 will be described below with reference to FIGS. 9A and 9B.

The dust bag 200 may be in an inserted state in the holder 60, and the lever 70 may be in the second state.

The dust bag 200 may be disposed in the dust container 10. The fixing plate 202 of the dust bag 200 may couple with the holder 60. That is, the fixing plate 202 of the dust bag 200 may be inserted along the pair of sliding grooves 63 of the holder 60 and fixed to a pre-set position through the fixing part 64.

Accordingly, the inlet 201 of the fixing plate 202 and the insertion opening 61 of the holder 60 may be disposed to a position facing each other.

Further, the lever 70 pushed to one direction by the fixing plate 202 may be rotated from the one surface 60-1 of the holder 60 toward the direction of the other surface 60-2 centered on the coupling axis 67.

For example, the first lever part 70-1 may be interacted with the fixing plate 202 and rotated, and the second lever part 70-2 formed integrally with the first lever part 70-1 may move toward a direction close to the other surface 60-2 of the holder 60.

The holder 60 may be moved by the user to a contact surface 13 in the dust container 10 centered on the rotating protrusion 65, and because the latch 68 of the holder 60 is inserted and fixed to the latch groove 14 of the dust container 10, the holder 60 may be fixed on a surface of the dust container 10.

That is, when the lever 70 is in the second state, the holder 60 may be coupled on the contact surface 13 of the dust container 10. That is, based on the holder 60 and the duct 40 being in a coupled state, the holder 60 may be coupled on the contact surface 13 of the dust container 10. Accordingly, based on the holder 60 forming a large inner space S of the dust container 10, the amount of foreign substance and dust that may be contained in the dust bag 200 may increase.

Based on the holder 60 being fixed to the one surface of the dust container 10, the one end part 40*a* of the duct 40 extendingly disposed to the inner part of the dust container 10 may be inserted in the insertion opening 61 of the holder 60, and the one end part 40*a* of the duct 40 may be connected to the inner part of the dust bag 200.

That is, when the lever 70 is in the second state, the one end part 40*a* of the duct 40 may be inserted into the insertion opening 61.

Further, because the fixing plate 202 of the dust bag 200 may be continuously pressed with the lever 70, the second lever part 70-2 may maintain a state in which the second lever part 70-2 is moved closely with the other surface 60-2 of the holder.

Accordingly, the second lever part 70-2 may be disposed in the accommodating part 12 of the dust container 10. That is, the lever 70 may be in the rotated second state by being interacted with the dust bag 200. Further, the lever 70 may, based on being in the second state by being interacted with the dust bag 200, allow the coupling of the duct 40 and the holder 60.

Further, based on the holder 60 being fixedly disposed on the contact surface 13 of the dust container 10, the cover interacting part 62 formed at the upper end part of the holder 60 may also be disposed adjacent to the one surface of the dust container 10. Accordingly, the cover interacting part 62 may not be interacted with the interacting member 51 of the cover member 50, and the cover member 50 may close the inner space S of the dust container 10.

The user may detect whether the dust bag 200 of the station 1 is attached or detached through the holder 60, the lever 70, the protruding part 11, and the interacting member 51, and then prevent malfunctioning of the station and abnormal use by the user. Accordingly, the inner part of the station 1 may be prevented from being damaged because of dust not filtered in the inner part of the station 1 being scattered by not using the dust bag appropriate to the station 1.

Further, because the station 1 recognizes whether the dust bag 200 of the station 1 is attached or detached through mechanical configurations, the durability of the station 1 may be increased and the manufacturing costs may be significantly decreased.

In the above, various embodiments of the disclosure have been individually described, but each embodiment may not necessarily be implemented on its own, and the configuration and operation of each embodiment may also be implemented in combination with at least one other embodiment.

In addition, although exemplary embodiments have been illustrated and described above, the disclosure is not limited to the specific embodiments described above, and it will be understood by those skilled in the art that various changes in form and details may be made therein without departing from the spirit and scope as defined by the appended claims and their equivalents.

What is claimed is:

1. A station for suctioning dust from a robot cleaner, comprising:

a docking suction port to which a robot cleaner is connectable;

a dust container to store dust from the robot cleaner when the robot cleaner is connected to the docking suction port;

a duct connected to the docking suction port and the dust container;

a cover member to open or close the dust container;

a holder disposed in the dust container, and to which a dust bag is mountable; and a lever configured to separate a connection of the holder and the duct and thereby preventing the cover member from closing the dust container when the dust bag is not mounted to the holder, and to allow the connection of the holder and the duct thereby allowing the cover member to close the dust container when the dust bag is mounted to the holder.

2. The station of claim 1, comprising a driver configured to suction the dust from the robot cleaner to the dust bag when the robot cleaner is connected to the docking suction port.

3. The station of claim 2, wherein the lever is rotatably coupled to the holder, and based on the dust bag being separated from the holder, the lever is protruded toward the duct and is maintained in a first state separating the connection of the duct and the holder, and based on the dust bag being mounted to the holder, the lever is in a second state pushed by the dust bag and rotating toward the holder.

4. The station of claim 3, wherein one end part of the duct is protruded and disposed in an inner space of the dust container, wherein the holder comprises an insertion opening for the one end part of the duct to be inserted, and wherein, based on the lever being in the first state, the one end part of the duct is spaced apart from the insertion opening, and based on the lever being in the second state, the one end part of the duct is inserted in the insertion opening.

5. The station of claim 3, wherein the dust container comprises:

a protruding part to interact with the lever in the first state; and an accommodating part to accommodate a part of the lever in the second state.

6. The station of claim 5, wherein the protruding part and the accommodating part are disposed to a position facing the lever which is rotatably coupled to the holder.

7. The station of claim 5, wherein the lever comprises:

a first lever part which rotates by being interacted with a part of the dust bag based on the dust bag being coupled to the holder; and a second lever part which is integrally formed with the first lever part, interacted with the protruding part in the first state, and disposed in the accommodating part in the second state.

8. The station of claim 3, wherein the holder comprises:

a sliding groove to which the dust bag is slidingly coupled on a surface of the holder; and wherein the lever in the first state is protruded and disposed on the surface of the holder.

9. The station of claim 8, wherein the holder comprises:

an elastic member pressing the lever to maintain the lever at the first state to be protruded and disposed continuously on the surface of the holder.

10. The station of claim 3, wherein the holder comprises a lever groove provided for the lever to rotate, and wherein the lever moves between the first state, which is protruded and disposed on the one surface of the holder, and the second state, which is rotated by being interacted with dust bag.

11. The station of claim 1, wherein the dust container comprising an inner space formed therein to be openable and closable by the cover member, and the cover member includes an interacting member protruded toward an inner space of the dust container, wherein the holder comprises a cover interacting part protruded on an upper part of the holder, and wherein based on the holder and the duct being spaced apart, the cover interacting part contacts with the interacting member and prevents the cover member from closing.

12. The station of claim 1, wherein the holder, based on the holder and the duct being in a coupled state, is coupled on a contact surface of the dust container.

13. A station for suctioning dust from a robot cleaner, comprising:

a docking suction port to which a robot cleaner is connectable;

a dust container to store dust from the robot cleaner when the robot cleaner is connected to the docking suction port;

a duct connected to the docking suction port and the dust container;

a cover member to open or close the dust container, the cover member including an interacting member protruded from an inner surface of the dust container;

a holder disposed in the dust container, and to which a dust bag is mountable, the holder comprising a cover interacting part protruded on an upper part of the holder; and a lever configured to separate a connection of the holder and the duct and thereby preventing the cover member from closing the dust container based on an interaction between the interacting member and the cover interacting part when the dust bag is not mounted to the holder, and to allow the connection of the holder and the duct thereby allowing the cover member to close the dust container based on a non-interaction between the interacting member and the cover interacting part when the dust bag is mounted to the holder.

* * * * *